US005878984A

United States Patent [19]

Grieser et al.

[11] Patent Number: 5,878,984

[45] Date of Patent: Mar. 9, 1999

[54] FOOT FOR AN ARTICLE OF FURNITURE

[75] Inventors: Jerry D. Grieser, Archbold; Richard A. Nelson, Napoleon, both of Ohio

[73] Assignee: Sauder Woodworking Co., Archbold, Ohio

[21] Appl. No.: 878,735

[22] Filed: Jun. 19, 1997

Related U.S. Application Data

[60] Provisional application No. 60/041,318 Mar. 20, 1997.

[51] Int. Cl.[6] ..... A47B 91/00; A47G 29/00

[52] U.S. Cl. ..... 248/188.8; 248/188.8; 248/688; 248/346.5

[58] Field of Search ..... 248/188, 188.8, 248/688, 615, 618; 297/463.1, 463.2; 403/402, 381, 231; 108/351.11; 5/310

[56] References Cited

U.S. PATENT DOCUMENTS

| | | | |
|---|---|---|---|
| 687,114 | 10/1901 | Brown | 403/381 |
| 1,398,695 | 10/1921 | Hull | 403/231 |
| 2,305,790 | 2/1942 | Martin | 248/24 |
| 2,546,492 | 8/1951 | Booth | 248/188.8 |
| 3,103,374 | 9/1963 | Portnoy | 248/188 |
| 3,419,240 | 12/1968 | Santic | 248/350 |
| 4,450,655 | 5/1984 | Rosenthal | 248/223.41 |
| 5,482,396 | 1/1996 | Guillemet | 403/402 |

FOREIGN PATENT DOCUMENTS

| | | | |
|---|---|---|---|
| 7947 | of 1890 | United Kingdom | 248/188.8 |
| 617884 | 2/1949 | United Kingdom | 248/188.8 |

OTHER PUBLICATIONS

Pitkin; "A Joint For The Work Bench", Scientific American, p. 120, Feb. 1909.

*Primary Examiner*—Leslie A. Braun
*Assistant Examiner*—Michael D. Nornberg
*Attorney, Agent, or Firm*—Emch, Schaffer, Schaub & Porcello Co., L.P.A.

[57] ABSTRACT

A foot for an article of furniture having a groove. The foot includes a base, at least one side wall extending upwardly from the base and at least one T-shaped projection being positioned on the side wall. The projection is received by the groove of the article of furniture.

9 Claims, 6 Drawing Sheets

FOOT FOR AN ARTICLE OF FURNITURE

This application claims benefit of provisional application Ser. No. 60/041,318 filed Mar. 20, 1997, a 35U.S.C. 199(e) which invention is fully set forth in the following specification.

BACKGROUND OF THE INVENTION

The present invention relates generally to a foot for an article of furniture. More specifically, the invention is directed to a furniture foot including, among other things, at least one T-shaped projection positioned on at least one side wall of the foot.

Furniture feet are known in the art. These prior art feet are usually attached directly to the bottom of an article of furniture. The feet are used to space the article of furniture from the floor. In the past, furniture feet have been attached to the furniture article by screws, staples, nails, or glue.

It has been found that there is a need for a foot for an article of furniture that can be attached to an article of furniture without screws, staples, nails, or glue. The present invention satisfies this need.

SUMMARY OF THE INVENTION

The present invention is directed to a foot for an furniture article having a groove that includes a base. At least one side wall extends upwardly from the base. At least one T-shaped projection is positioned on the side wall. The projection is received by the groove of the furniture article.

It is the primary object of the present invention to provide a furniture foot that includes at least one T-shaped projection that is received by a groove of a furniture article.

It is another important object of the present invention to provide a durable and relatively inexpensive furniture foot.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
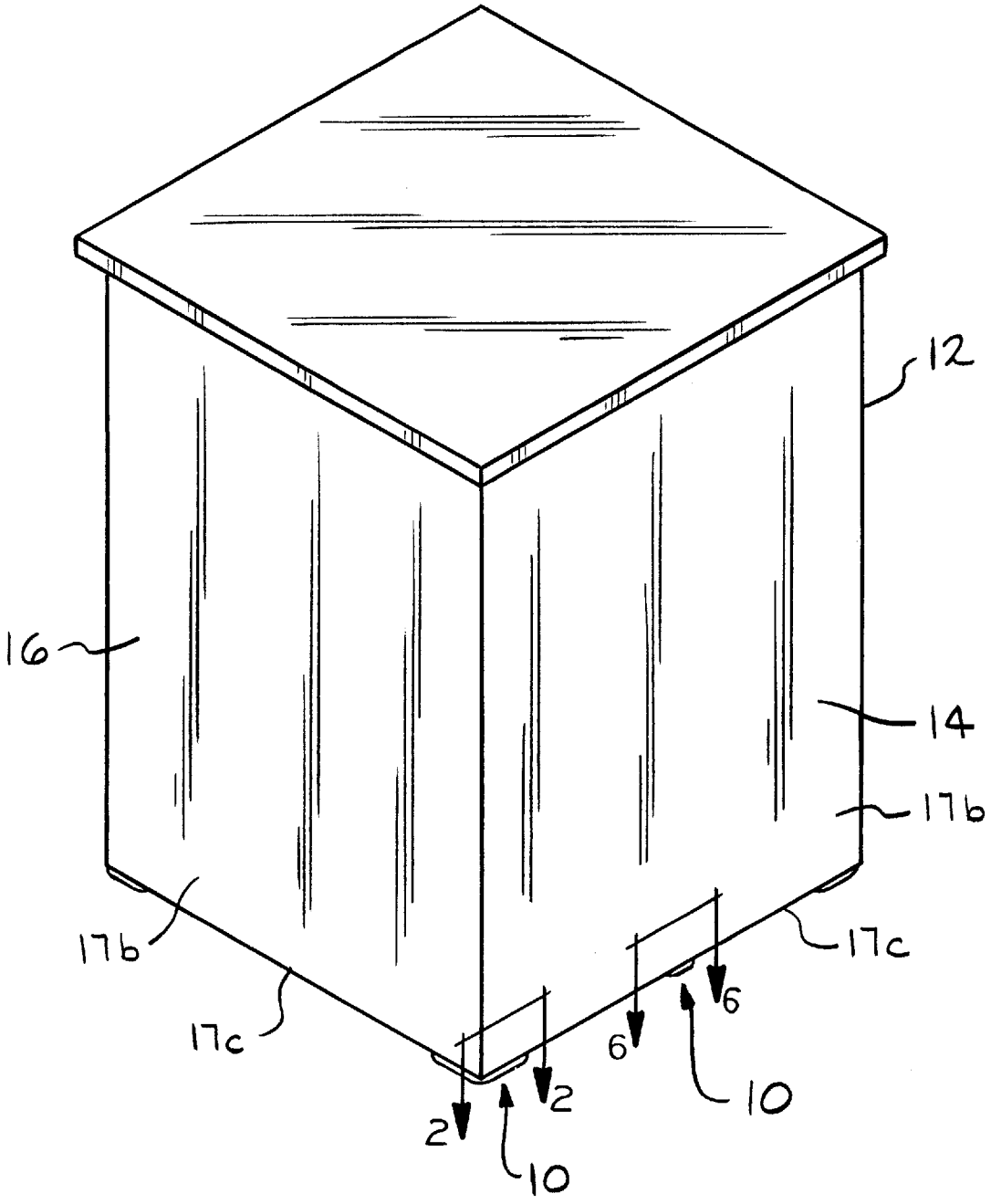
FIG. 1 is a perspective view of an article of furniture that can be used in conjunction with one or more feet according to the present invention.

The preferred embodiment and best mode of the present invention will now be described in detail with reference being made to the drawings. The furniture foot of the present invention is indicated generally in the drawings by the reference number "10".

Figure 2:
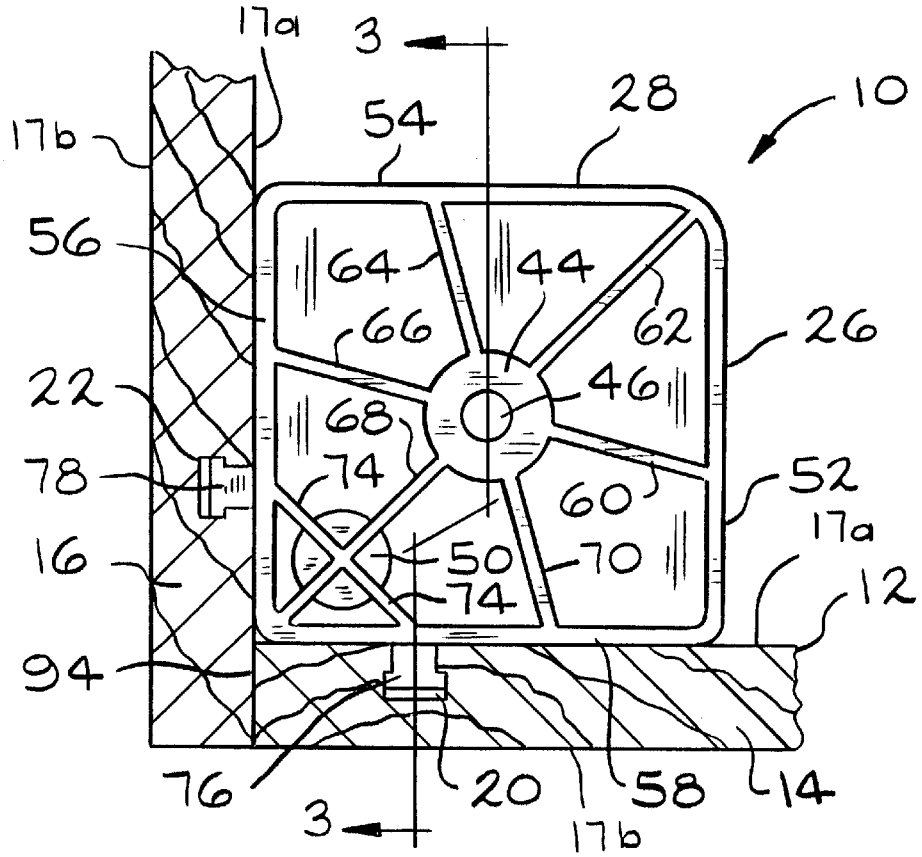
FIG. 2 is a cross-sectional view taken through line 2—2 of FIG. 1.
Figure 3:
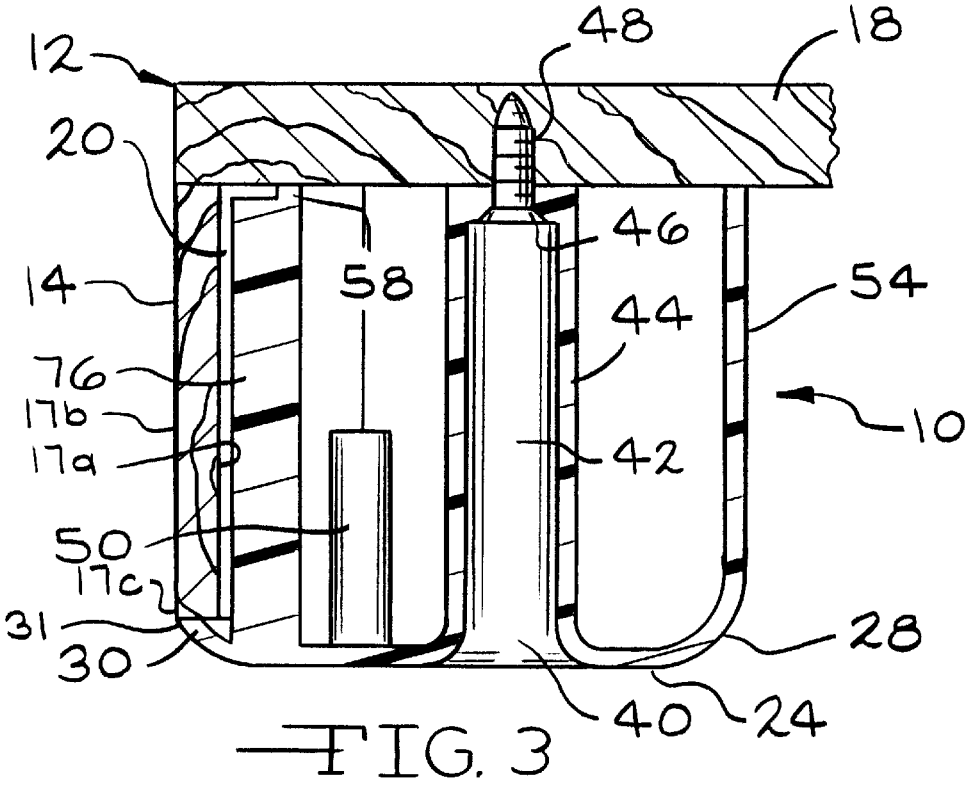
FIG. 3 is a cross-sectional view taken through line 3—3 of FIG. 2.

Referring to FIGS. 1–3, the furniture foot 10 can be used in conjunction with, for example, an article of furniture 12 having a first paild wall 14 and a second paild wall 16. As shown in FIGS. 1–3, each of the first and second walls 14 and 16 has an inner side surface 17*a*, an outer side surface 17*b* and a lower edge 17*c*. As shown in FIG. 3, the article of furniture 12 can include a bottom wall 18. As shown in FIG. 2, the inner side surface 17*a* of the first wall 14 defines an upwardly extending T-shaped first groove 20 and the inner side surface 17*a* of second wall 16 defines an upwardly extending T-shaped second groove 22.

It should be understood that the furniture foot 10 of the present invention can be used with a variety of furniture articles. In a preferred embodiment, the furniture foot 10 is used in conjunction with a Ready-To-Assemble (RTA) furniture article that is purchased by a consumer in an unassembled condition and is subsequently assembled by the consumer.

Figure 8:
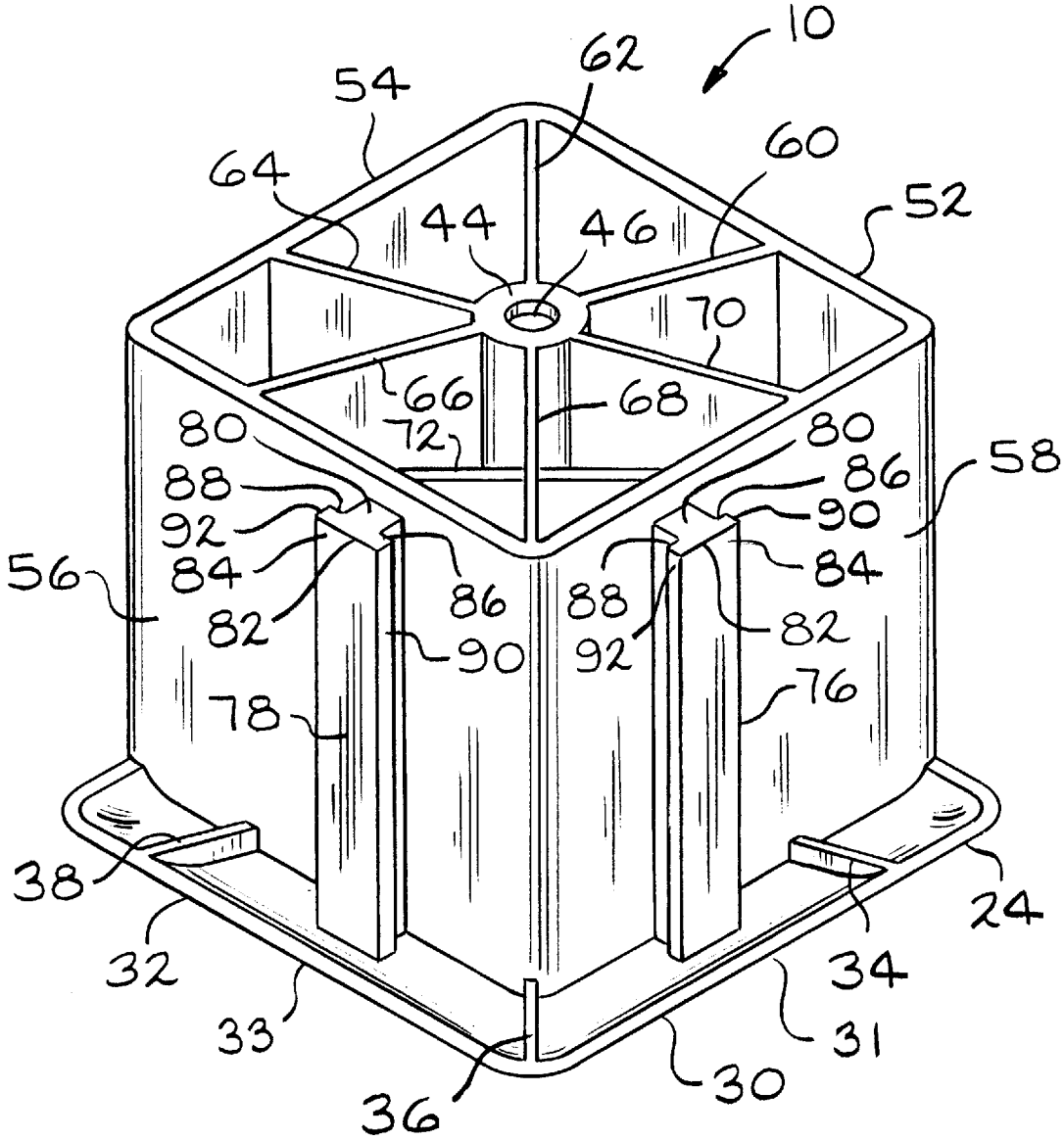
FIG. 8 is a perspective view of the first embodiment furniture foot according to the present invention.

Referring to FIGS. 2, 3 and 8, the furniture foot 10 includes a planar base 24. The base 24 includes a first rounded corner edge 26 adjacent a second rounded corner edge 28. As shown in FIG. 8, the base 24 includes a first furniture edge 30 having an outer edge 31 adjacent a second furniture edge 32 having an outer edge 33. The base 24 includes first, second and third edge support ribs 34, 36 and 38, respectively, for supporting the first and second furniture edges 30 and 32. Referring to FIGS. 2 and 3, the base 24 includes an opening 40 in communication with a fastening means channel 42 defined by a generally circular fastening means wall 44. The fastening means wall 44 defines a second opening 46. As shown in FIG. 3, when the second opening 46 is positioned adjacent the bottom wall 18, fastening means, such as a threaded woodscrew 48, can be inserted through the opening 40, the fastening means channel 42 and the second opening 46 so that the screw can be inserted into the bottom wall 18 to attach the furniture foot 10 to the bottom wall. As shown in FIG. 3, the furniture foot 10 defines a second channel 50 adjacent the base 24.

Referring to FIGS. 2, 3 and 8, the furniture foot 10 includes a first side wall 52, a second side wall 54, a third side wall 56 and a fourth side wall 58. Each of the side walls 52, 54, 56 and 58 extends upwardly from the base 24. As shown in FIG. 8, the third and fourth side walls 56 and 58 extend upwardly from the base 24 adjacent the furniture edges 30 and 32, respectively. The third and fourth side walls 56 and 58 are spaced inwardly of the outer edges 31 and 33 of the furniture edges 30 and 32, respectively. As shown in FIG. 8, first, second, third, fourth, fifth and sixth support struts 60, 62, 64, 66, 68 and 70, respectively, extend upwardly from the base 24 between the fastening means wall 44 and the side walls 52, 54, 56 and 58. A side support 72 extends upwardly from the base 24 between the third and fourth side walls 56 and 58. The first, second, third, fourth, fifth and sixth support struts 60, 62, 64, 66, 68 and 70, respectively, and the side support 72 act to support the first, second, third and fourth side walls 52, 54, 56 and 58, respectively.

Referring still to FIGS. 2, 3 and 8, the furniture foot 10 includes a first T-shaped projection 76 and a second T-shaped projection 78. The first T-shaped projection 76 is positioned on the fourth side wall 58. As shown in FIG. 8, the first T-shaped projection 76 extends upwardly from the first furniture edge 30 of the base 24. The second T-shaped projection 78 is positioned on the third side wall 56, which is adjacent the fourth side wall 58. The second T-shaped projection 78 extends upwardly from the second furniture edge 32 of the base 24.

Referring to FIG. 8, each of the first and second T-shaped projections 76 and 78 includes a central portion 80 and a terminal portion 82. The terminal portion 82 includes a front wall 84 and first and second opposed back walls 86 and 88. The T-shaped projections further include a first end wall 90 and an opposed second end wall 92. The front wall 84 is substantially parallel to the first and second back walls 86 and 88. The first end wall 90 is substantially parallel to the second end wall 92. The front and back walls 84, 86 and 88, respectively, are substantially perpendicular to the first and second end walls 90 and 92. The terminal portion 82 defines a geometric configuration, such as a rectangle. As shown in FIG. 2, the first and second T-shaped projections 76 and 78 are positioned in the first and second grooves 20 and 22, respectively, which have configurations corresponding to the projections, to join the furniture foot 10 to the first and second walls 14 and 16 of the furniture article 12. As shown in FIG. 3, the furniture edges 30 and 32 of the third and fourth side walls 56 and 58, respectively, engage the lower edges 17*c* of the first and second walls 14 and 16, respectively.

Referring to FIG. 2, the furniture foot 10 is used with a butt joint 94 between the first and second walls 14 and 16. When so positioned, the furniture foot 10 acts to help hold the butt joint 94 together to provide structural integrity to the furniture article 12 while acting as a foot for the furniture article. As it will be appreciated, the furniture foot 10 is attached to the furniture article 12 by the first and second T-shaped projections 76 and 78, without the need for screws, staples, nails, glue, or the like.

Figure 4:
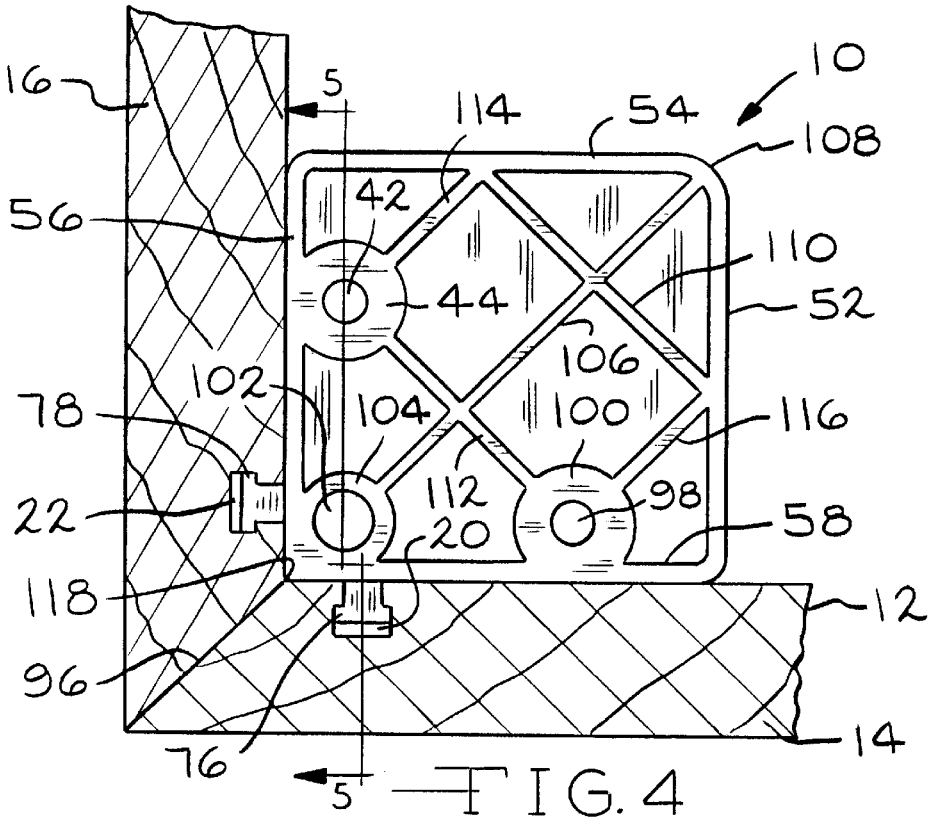
FIG. 4 is a cross-sectional view similar to the view of FIG. 2 showing a second embodiment foot according to the present invention.
Figure 5:
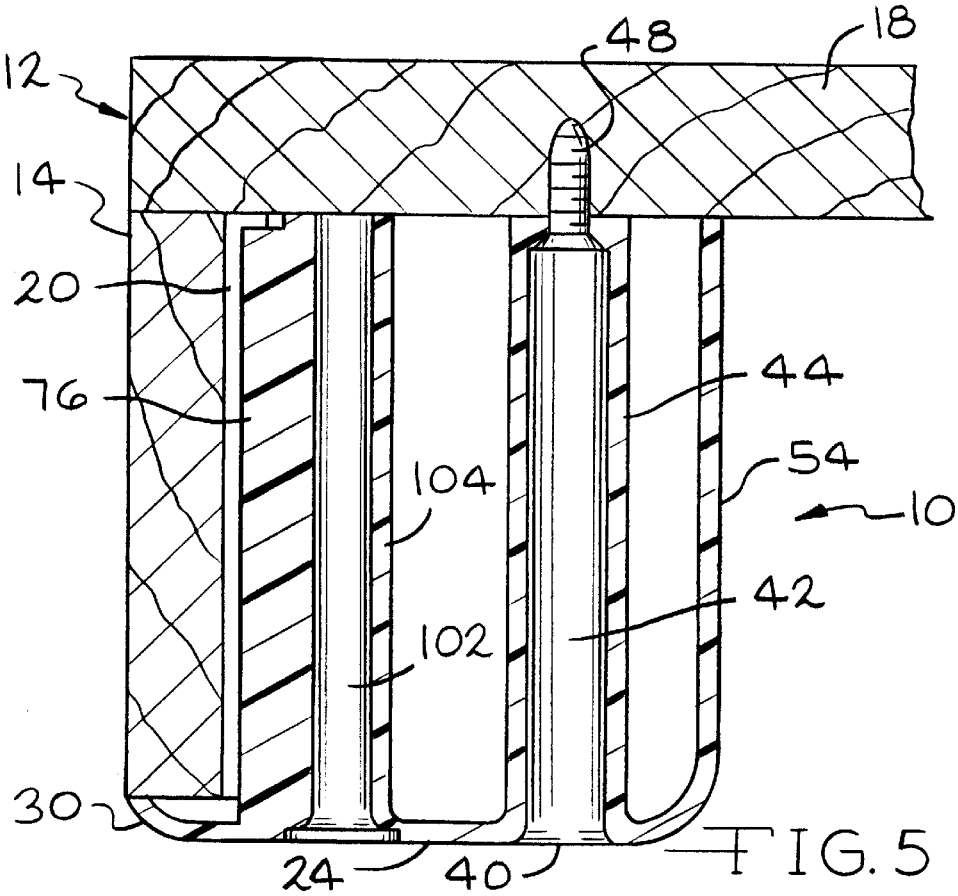
FIG. 5 is a cross-sectional view taken through line 5—5 of FIG. 4.

A second embodiment furniture foot 10 is shown in FIGS. 4 and 5. This embodiment is used at a mitered joint 96 between the first and second walls 14 and 16. The second embodiment furniture foot 10 includes the base 24, the side walls 52, 54, 56 and 58, and the first and second T-shaped projections 76 and 78 as described above. However, in this embodiment, the furniture foot 10 includes a first fastening means channel 42 defined by a first fasting means wall 44 and a second fastening means channel 98 defined by a second fastening means wall 100. The furniture foot 10 further includes a third channel 102 defined by a third channel wall 104 adjacent the first and second T-shaped projections 76 and 78. As shown in FIG. 4, a first support wall 106 extends upwardly from the base 24 between the third channel wall 104 and the intersection point 108 of the first and second side walls 52 and 54. A second support wall 110 extends upwardly from the base 24 between the first and second side walls 52 and 54. A third support wall 112 extends upwardly from the base 24 between the first fastening means wall 44 and the second fastening means wall 100. A fourth support wall 114 extends upwardly from the base 24 between the fastening means wall 44 and the second side wall 54. A fifth support wall 116 extends upwardly from the base 24 between the second fastening means wall 100 and the first side wall 52. As shown in FIG. 4, the first and second T-shaped projections 76 and 78 are positioned on the third and fourth side walls, respectively, relatively close to the second intersection point 118 of the third and fourth side walls 56 and 58 as compared to the first embodiment. The positioning of the first and second T-shaped projections 76 and 78 in the second embodiment is due to the mitered joint 96 of the first and second walls 14 and 16.

Figure 6:
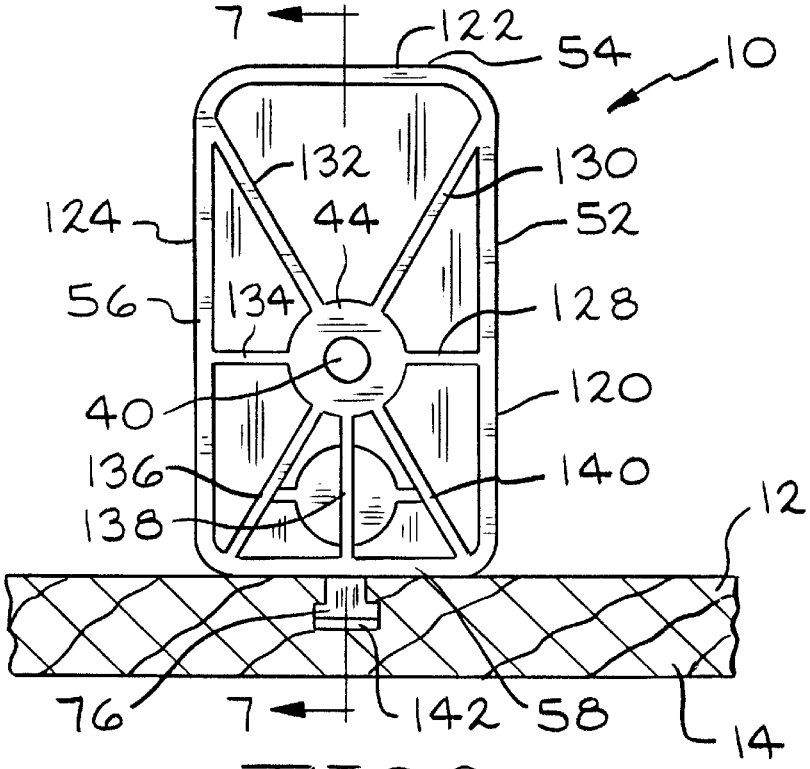
FIG. 6 is a cross-sectional view of a third embodiment foot according to the present invention taken through line 6—6 of FIG. 1.
Figure 9:
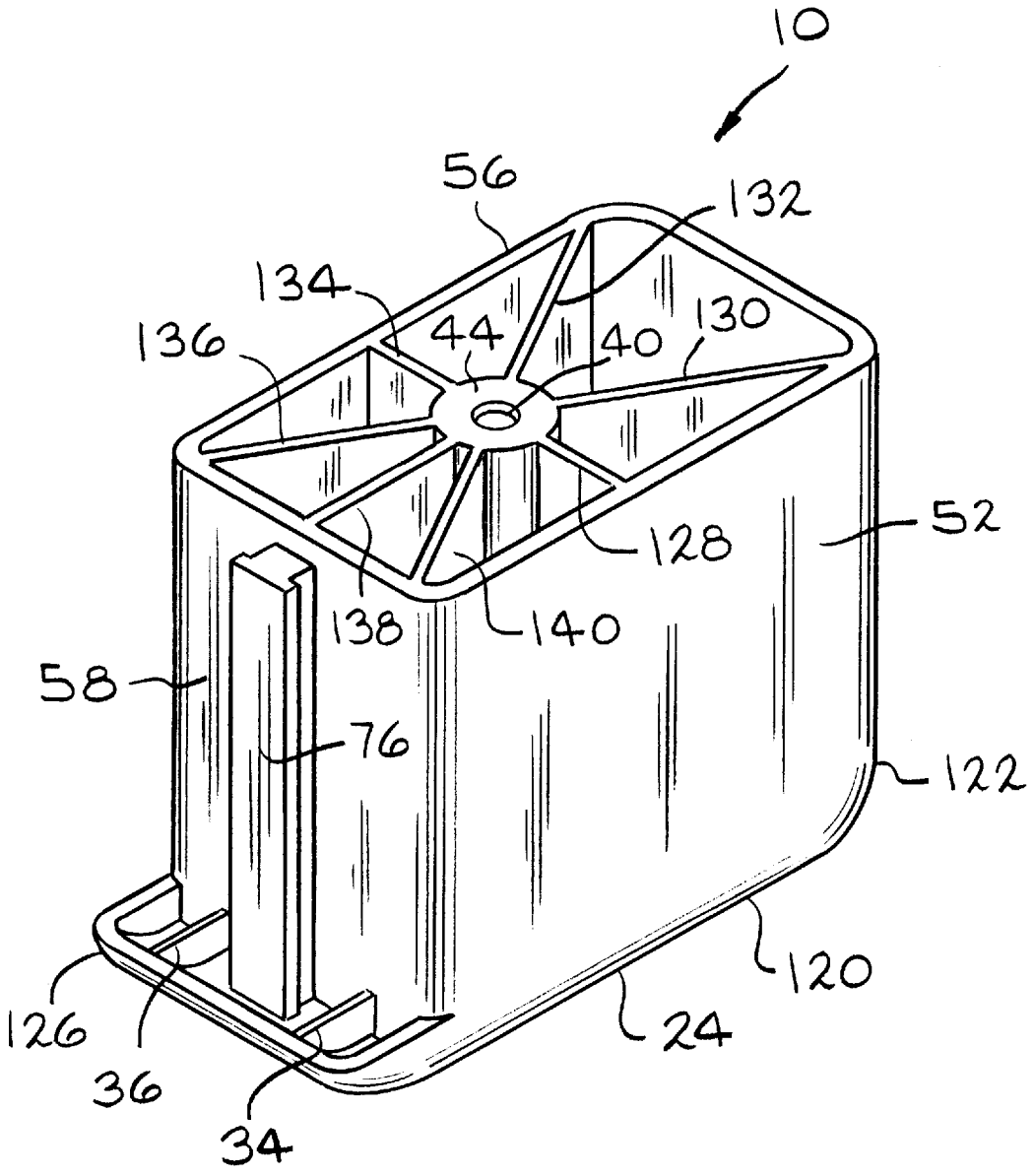
FIG. 9 is a perspective view of the third embodiment furniture foot according to the present invention.

A third embodiment furniture foot 10 is shown in FIGS. 1, 6, 7 and 9. As shown in FIG. 1, the third embodiment furniture foot 10 is used along the first wall 14 of the furniture wall 12. The third embodiment furniture foot 10 can also be used on a skirt for a furniture article. This embodiment includes a base 24 having first, second, and third rounded corner edges 120, 122 and 124, respectively, and a single furniture edge 126. As shown in FIG. 9, the base 24 includes first and second ribs 34 and 36 adjacent the furniture edge 126. The furniture foot 10 includes first, second, third and fourth side walls 52, 54, 56 and 58, respectively. The furniture foot 10 includes a fastening means channel 42 defined by a fastening means wall 44. The channel 42 includes an opening 40 adjacent the base 24 and an opposed second opening 46 for receiving a threaded screw 48 as described above. The furniture foot 10 further defines a second channel 50. As shown in FIG. 6, a first support member 128 extends upwardly from the base 24 between the fastening means wall 44 and the first side wall 52. A second support member 130 extends between the wall 44 and the first side wall 52. A third support member 132 extends between the wall 44 and the third side wall 56. A fourth support member 134 extends between the wall 44 and the third side wall 56. A fifth support member 136 extends between the wall 44 and the fourth side wall 58. A sixth support member 138 extends between the wall 44 and the fourth side wall 58. Finally, a seventh support member 140 extends between the wall 44 and the fourth side wall 58.

Figure 7:
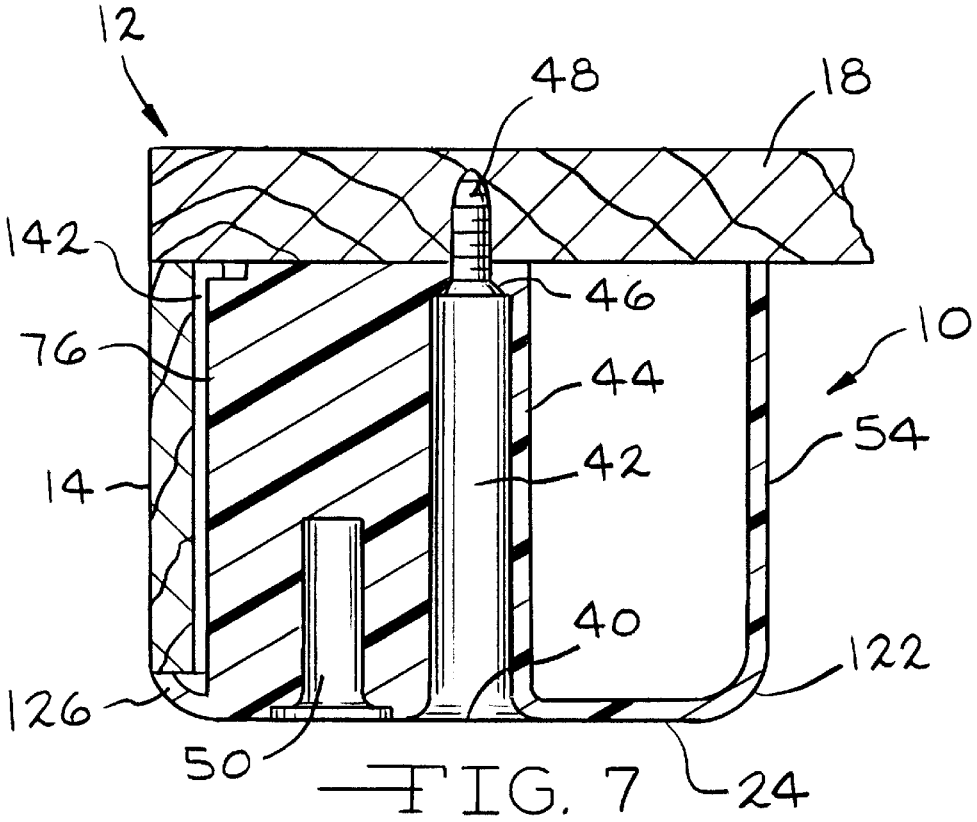
FIG. 7 is a cross-sectional view taken through line 7—7 of FIG. 6.

Still referring to FIGS. 6, 7 and 9, the third embodiment furniture foot 10 includes a single T-shaped projection 76 that is positioned on the fourth side wall 58. The T-shaped projection 76 extends upwardly from he furniture edge 128 of the base 24. As shown in FIG. 6, the T-shaped projection 76, which has a configuration as described above, is received by a side groove 142 that is defined by the first wall 14 of the furniture article 12. The side groove 142 has a configuration that corresponds to the configuration of the T-shaped projection 76.

All of the embodiments of the furniture foot 10 as described above, are comprised of a durable plastic material. The plastic material is an important feature of the present invention due to its ability to be formed into a variety of shapes and also because of its relatively low cost as compared to other materials.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A foot assembly supporting an article of furniture on a support surface, comprising:

an article of furniture having at least one solid wall having an inner side surface and an outer side surface said inner side surface defining at least one upwardly extending T-shaped groove; and a foot having a planar base including at least one outwardly extending furniture edge engaging a lower edge of said wall, at least one side wall extending upwardly from said planar base adjacent said furniture edge and being spaced inwardly of an outer edge of said furniture edge of said planar base and at least one T-shaped projection being positioned on said side wall of said foot, said T-shaped projection extending upwardly from said furniture edge, said T-shaped projection being received by said T-shaped groove to join said foot to said article of furniture, and a threaded fastening means securing said foot to said article of furniture, whereby said base engages said support surface to support said article of furniture on said support surface.

2. The invention of claim 1, wherein said planar base of said foot includes at least two corner edges.

3. The invention of claim 2, wherein said corner edges are substantially rounded.

4. The invention of claim 1, wherein said planar base includes two furniture edges.

5. The invention of claim 1, wherein said planar base defines at least one opening and at least one fastening means channel for receiving said threaded fastening means.

6. The invention of claim 1, wherein said foot includes four side walls.

7. The invention of claim 6, wherein said foot includes two T-shaped projections positioned on two adjacent side walls.

8. The invention of claim 1, wherein said T-shaped projection includes a central portion and a terminal portion including a front wall and two opposed back walls, a first end wall and an opposed second end wall, said front wall being substantially parallel to said back walls, said first end wall being substantially parallel to said second end wall, said front and back walls being substantially perpendicular to said first and second end walls, said terminal portion defining a geometric configuration.

9. The invention of claim 1, wherein said foot is comprised of plastic.

* * * * *